United States Patent [19]

Meyer

[11] 4,129,296

[45] Dec. 12, 1978

[54] RIDING TOY WITH REMOVABLE BODY PORTION

[75] Inventor: Burton C. Meyer, Downers Grove, Ill.

[73] Assignee: Marvin Glass & Associates, Chicago, Ill.

[21] Appl. No.: 767,399

[22] Filed: Feb. 14, 1977

[51] Int. Cl.[2] ..... A63G 17/00

[52] U.S. Cl. ..... 272/52; 297/272

[58] Field of Search ..... 272/52, 52.5, 53.1, 272/53.2; 297/258, 270, 271, 272, 283; 280/1.16, 1.188, 1.193

[56] References Cited

U.S. PATENT DOCUMENTS

| | | | |
|---|---|---|---|
| 419,405 | 1/1890 | Bessette | 272/52.5 |
| 1,846,393 | 2/1932 | Hankins | 272/52 |
| 2,372,384 | 3/1945 | Lutz | 297/258 X |
| 3,075,763 | 1/1963 | May | 272/52.5 |
| 3,893,731 | 7/1975 | Maggs | 297/DIG. 1 X |

*Primary Examiner*—Anton O. Oechsle

*Attorney, Agent, or Firm*—Mason, Kolehmainen, Rathburn & Wyss

[57] ABSTRACT

A riding toy is provided which has a separate rigid base on top of which is removably mounted a body in the form of a figure, such as a horse, other animal, or the like, which is fabricated of a flexible outer cover enclosing rigidifying stuffing material. The base is in the form of a rocker so that the body, when placed on the rocker, can be used as a riding toy. The body, when removed from the base, can be used as a separate support.

7 Claims, 5 Drawing Figures

RIDING TOY WITH REMOVABLE BODY PORTION

BACKGROUND AND SUMMARY OF THE INVENTION

This invention relates to toys and particularly to a riding toy on which a child may sit and which has a soft body portion removably mounted on a rigid base which is in the form of a rocker. The child can remove the body from the base as a separate support for use such as a pillow or the like.

More particularly, the body has flexible straps which are positionable through apertures in the rocker base and placeable about bosses mounted on the underside of the base to hold the body to the base for use as a riding toy, but the flexible straps can be released from the bosses for using the body as a separate support. The base has outwardly extending foot supports for maintaining balance and dexterity when riding the toy in a rocking fashion.

The principal object, therefore, of the present invention is to provide a new and improved novel toy as described above.

Other objects, features and advantages of the invention will be apparent from the following detailed description taken in conjunction with the accompanying drawings.

DETAILED DESCRIPTION OF THE INVENTION

Figure 1:
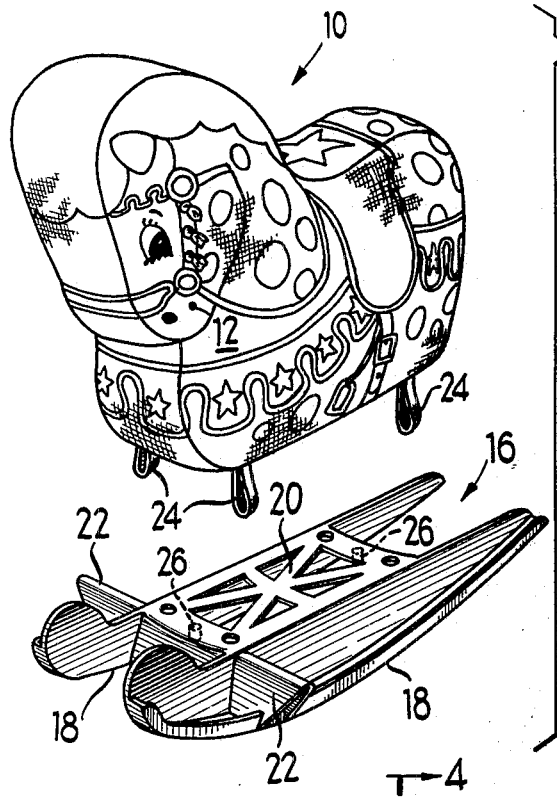
FIG. 1 is a perspective view of the toy of the present invention in exploded form with the body disconnected from the base.

Referring to the drawings in greater detail, the riding toy combination of the present invention includes a body, generally designated 10, which is fabricated of a flexible outer covering 12 such as plastic sheet material (see FIGS. 3 and 4) which encloses particulate material 14 (see FIGS. 3 and 4) which support and maintain the configuration of the body.

Figure 2:
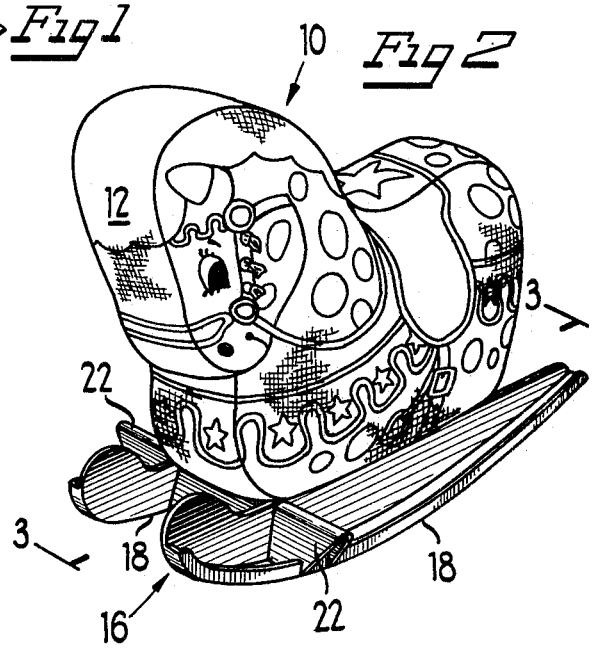
FIG. 2 is a perspective view of the toy of the present invention showing the body connected to the base.

The body is removably supported on a base, generally designated 16, which is in the form of a rocker having two runners 18 joined by a truss structure 20 extending between the runners. Each of the rocker runners 18 protrude laterally outwardly so as to extend from the body 10, as shown best in FIG. 2, to provide foot support portions 22 so that as a child sits on the body 10, the child will have foot leverage to rock the toy by placing his feet on top of the runners for moving capabilities.

Figure 3:
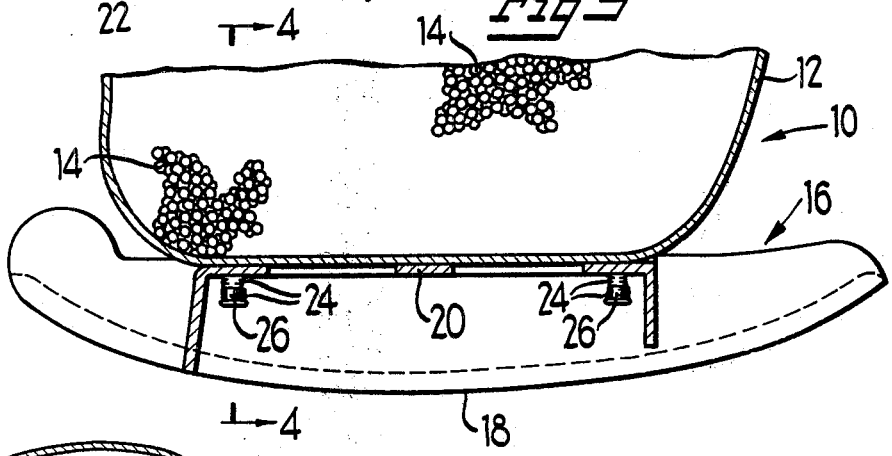
FIG. 3 is an enlarged vertical section, fragmented, taken generally along line 3—3 of FIG. 2.
Figure 4:
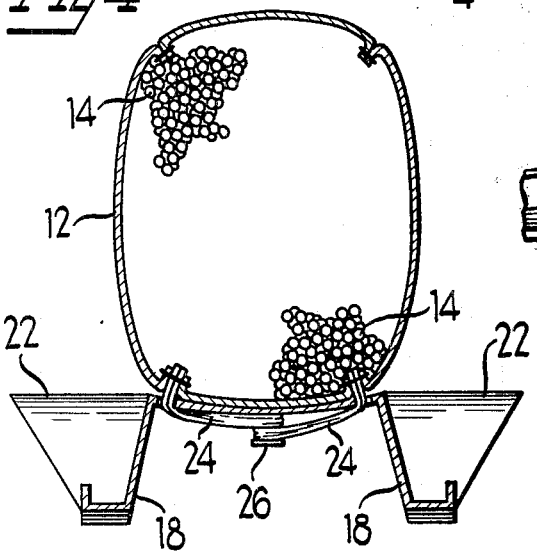
FIG. 4 is a full vertical section taken along line 4—4 of the fragmented view of FIG. 3.
Figure 5:
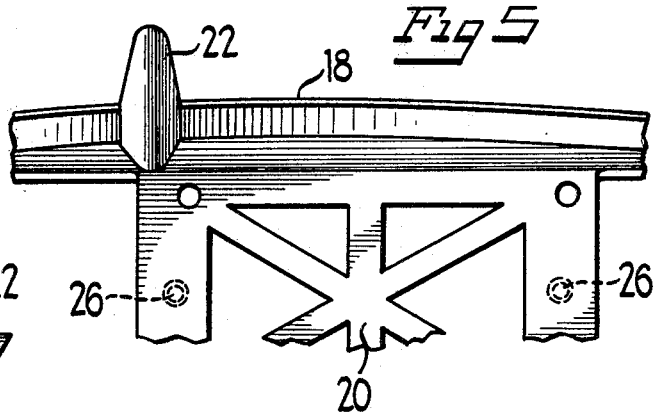
FIG. 5 is a fragmented, enlarged view of a portion of the base frame shown in FIG. 1.

In addition, the body has four flexible straps 24 which, as best seen in FIG. 4, can be wrapped about bosses 26 which protrude from the bottom of the base 16 so as to maintain the body in proper position on top of the base but be removable therefrom. The bosses also are shown in FIG. 3.

With this invention, a child is provided with a rocker-type toy which can be used for manual dexterity and yet the body of the toy (fabricated of the flexible outer covering 12 housing the particulate matter 14) can be used as a separate item for use in play, for instance as a pillow or stationary seat.

The foregoing detailed description has been given for clearness of understanding only and no unnecessary limitations should be understood therefrom as some modifications will be obvious to those skilled in the art.

I claim:

1. A riding toy, comprising:

a separate rigid base in the form of a rocker;

a body supported on said base, said body being fabricated of substantially soft cushion-like material on which a child may comfortably sit; and means removably mounting said body on said base, and means comprising a pair of flexible straps on said body and bosses on said base about which said flexible straps can be wrapped, whereby the body can be removably mounted on the base.

2. The riding toy of claim 1 wherein said body is shaped at the bottom thereof to the contour of said base for mating relationship therewith.

3. The riding toy of claim 1 wherein said base has apertures through which said flexible straps extend for wrapping about the bosses which are disposed on the underside of said base.

4. The riding toy of claim 1 wherein said base extends transversely outwardly from said body so as to provide foot supports for the child while using the toy with the body mounted on the base.

5. The riding toy of claim 1 wherein said body is fabricated of a flexible outer covering substantially filled with particulate stuffing material.

6. The riding toy of claim 1 wherein said body is fabricated generally in the shape of a toy horse.

7. The riding toy of claim 1 including a generally flat bottom surface on said body to facilitate use of the riding toy separate from said rigid base.

* * * * *